US006153872A

United States Patent [19]

Hagmann et al.

[11] Patent Number: 6,153,872

[45] Date of Patent: Nov. 28, 2000

[54] OPTOELECTRONIC DEVICES IN WHICH A RESONANCE BETWEEN OPTICAL FIELDS AND TUNNELING ELECTRONS IS USED TO MODULATE THE FLOW OF SAID ELECTRONS

[75] Inventors: Mark J. Hagmann, Miami; Manuel Brugat, Cooper City, both of Fla.

[73] Assignee: Florida International University for and on behalf of the Board of Regents, Miami, Fla.

[21] Appl. No.: 09/122,965

[22] Filed: Jul. 27, 1998

Related U.S. Application Data

[60] Provisional application No. 60/072,389, Jan. 9, 1998.

[51] Int. Cl.[7] ..... H01J 40/14

[52] U.S. Cl. ..... 250/207; 313/537; 343/721

[58] Field of Search ..... 250/207; 343/720, 343/721; 313/537

[56] References Cited

U.S. PATENT DOCUMENTS 5,508,627 4/1996 Patterson ..... 324/752

OTHER PUBLICATIONS

M. J. Hagmann, "Resonance due to the Interaction of Tunneling Particles with Modulation Quanta," Applied Physics Letters, vol. 66, Feb. 13, 1995, pp. 789–791.

M. J. Hagmann, "Calculations for an Experiment for Determining the Duration of Quantum Tunneling with a Laser–Illuminated Field Emitter," Journal of Vacuum Science and Technology B, vol. 13, Mar./Apr. 1995, pp. 403–406.

M. J. Hagmann, "Simulations of the Interaction of Tunneling Electrons with Optical Fields in Laser–Illuminated Field Emission," Journal of Vacuum Science and Technology B, vol. 13, May/Jun., 1995, pp. 1348–1352.

M. J. Hagmann, "Mechanism for Resonance in the Interaction of Tunneling Particles with Modulation Quanta," Journal of Applied Physics, vol. 78, Jul. 1, 1995, pp. 25–29.

M. J. Hagmann, "Efficient Numerical Methods for Solving the Schrodinger Equation with a Potential Varying Sinusoidally with Time," International Journal of Quantum Chemistry, vol. 56, Quantum Symposium Issue No. 29, 1995, pp. 289–295 month unknown.

M. J. Hagmann, "Microwave Tunneling Current from the Resonant Interaction of an Amplitude Modulated Laser with a Scanning Tunneling Microscope," Journal of Vacuum Science and Technology B, vol. 14, Mar./Apr., 1996, pp. 838–841.

M. J. Hagmann "Efficient Numerical Method for Finding the Initial Response of Quantum Processes to Changes in the Potential," International Journal of Quantum Chemistry, vol. 60, Quantum Symposium Issue No. 30, 1996, pp. 1231–1239 month unknown.

M. Brugat and M. J. Hagmann, "Measurements of Modulation of the Current in a Field Emitter Caused by a Laser," Journal de Physique IV, vol. 6, Colloque C5, Sep., 1996, pp. 147–151.

(List continued on next page.)

*Primary Examiner*—Que T. Le
*Assistant Examiner*—Thanh X. Luu
*Attorney, Agent, or Firm*—Marshall, O'Toole, Gerstein, Murray & Borun

[57] ABSTRACT

An apparatus for high speed gating of electric current based on the resonant interaction of tunneling electrons with optical fields is disclosed. The present invention biases an electron-emitting tip with a DC voltage source and focuses an output from a laser on the electron-emitting tip to stimulate electron emission from the tip. The electron emission creates an electrical signal that is coupled to circuitry for further processing. In accordance with the present invention, various methods of coupling the electrical signal from the electron-emitting tip are disclosed, as are various methods of reducing the magnitude of the laser output needed to stimulate electron emission, and methods of enhancing the static current density.

57 Claims, 4 Drawing Sheets

OTHER PUBLICATIONS

M. J. Hagmann, "Simulations of Modulation of the Current in a Field Emitter Caused by a CW or Pulsed Laser," Journal de Physique IV, vol. 6, Colloque C5, Sep., 1996, pp. 71–76.
M. J. Hagmann and M. Brugat, "Modulaton of the Current in a Field Emitter Caused by a Continuous Wave or Pulsed Laser: Simulations and Experimental Results," Journal of Vacuum Science and Technology B, vol. 15, Mar./Apr., 1997, pp. 405–409.
M. J. Hagmann, "Intensification of Optical Electric Fields Caused by the Interaction with a Metal Tip in Photofield Emission and Laser–Assisted Scanning Tunneling Microscopy," Journal of Vacuum Science and Technology B, vol. 15, May/Jun., 1997, pp. 597–601.
M. J. Hagmann, "Simulations of Laser–Assisted Field Emission within the Local Density Approximation of Kohn–Sham Density–Functional Theory," International Journal of Quantum Chemistry, vol. 65, Quantum Symposium Issue No. 31, 1997, pp. 857–865 month unknown.
M. J. Hagmann, "Simulations of the Generation of Broadband Signals from DC to 100 Thz by Photomixing in Laser–Assisted Field Emission," Ultramicroscopy (in press), Received Jul. 7, 1997.
M. J. Hagmann, Abstract of Presentation of "Design of an Experiment for Determining the Duration of Quantum Tunneling with a Laser–Illuminated Field Emitter," 7th International Vacuum Microelectronics Conference, Grenoble, France, Jul. 4–7, 1994.
M. J. Hagmann, Abstract of Presentation of "Design of an Experiment with a Laser–Illumitated Field Emitter in Order to Determine the Duration fo Quantum Tunneling," 41st International Field Emission Symposium, Rouen, France, Jul. 11–15, 1994.
M. J. Hagmann, Abstract of Presentation of "Experimental Design for Determining the Duration of Quantum Tunneling with Laser–Illuminated Field Emission," 41st National Symposium of the American Vacuum Society, Denver, Colorado, Oct. 24–28, 1994.
M. J. Hagmann, Abstract of presentation of "Efficient Numerical Methods for Solving the Schrodinger Equation with a Potential varying Sinusoidally with time," Sanibel Symposium, St. Augustine, Florida, Feb. 25–Mar. 4, 1995.
M. J. Hagmann, Abstract of presentation of "Microwave Generation due to the Resonant Interaction of Tunneling Particles with Modulation Quanta," STM'95, Eighth International Conference on Scanning Tunneling Microscopy/Spectroscopy, Snowmass Village, Colorado, Jul. 23–28, 1995.
M. J. Hagmann, Abstract of presentation of "Efficient Numerical Method for Finding the Initial Response of Quantum Processes to Changes in the Potential," Sanibel Symposium, St. Augustine, Florida, Feb. 24–Mar. 2, 1996.
M. J. Hagmann, Abstract of presentation of "Simulations of the Effect of an Intense Laser Pulse on the Tunneling Current in a Field Emitter," 24th Annual Symposium on Applied Vacuum Science & Technology, Orlando, Florida, Mar. 11–14, 1996.
M. Brugat and M. J. Hagmann, Abstract of Presentation of "Measurements of Modulation of Tunneling Current Caused by Laser Illumination of a Field Emitter," 24th Annual Symposium on Applied Vacuum Science & Technology, Orlando, Florida, Mar. 11–14, 1996.
M. J. Hagmann and M. Brugat, Abstract of Presentation of "Modulation of the Current in a Field Emitter Caused by a CW or Pulsed Laser–Simulations and Experimental Results," 9th International Vacuum Microelectronics Conference, St. Petersburg, Russia, Jul. 7–12, 1996.
M. J. Hagmann, Abstract of Presentation of "Simulations of Modulation of the Current in a Field Emitter Caused by a CW or Pulsed Laser," 43rd Intenational Field Emission Symposium, Moscow, Russia, Jul. 14–19, 1996.
M. Brugat and M. J. Hagmann, Abstract of Presentation of "Measurements of Modulation of the Current in a Field Emitter Caused by a Laser," 43rd International Field Emission Symposium, Moscow, Russia, Jul. 14–19, 1996.
M. J. Hagmann, Abstract of Presentation of "Use of Density Functional Theory to Simulate Laser–Assisted Field Emission with CW and Pulsed Lasers," 25th Annual Symposium on Applied Vacuum Science & Technology, Orlando, Florida, Feb. 17–20, 1997.
M. Brugat and M. J. Hagmann, Abstract of Presentation of "Measurements of Radio Frequencey Tunneling Current in Resonant Laser–Assisted Field Emission with an Amplitude Modulated Laser," 25th Annual Symposium on Applied Vacuum Science & Technology, Orlando, Florida, Feb. 17–20, 1997.
M. J. Hagmann, Abstract of Presentation of "Use of Density Functional Theory to Model the Effect of a CW or Pulsed Laser on Field Emission," Sanibel Symposium, St. Augustine, Florida, Mar. 1–7, 1997.
M. J. Hagmann, Abstract of Presentation of "Simulations of the Generation of Broadband Signals from DC to 100 THz by Photomixing in Laser–Assisted Field Emission," 44th International Field Emission Symposium, Tsukuba, Japan, Jul. 7–11, 1997.
Asakawa et al., "Use of Multiphoton Photoelectric Process to Generate a High Brightness Electron Beam for Free–Electron Lasers," *Applied Physics Letters,* vol. 64, No. 16, pp. 2056–2058, 1994 month unknown.
Hagmann, et al., "Modulation of the Current in a Field Emitter Caused by a Continuous Wave or Pulsed Laser: Simulations and Experimental Results," *Jourhal of Vacuum Science and Technology: Part B,* vol. 15, No. 2, pp. 405–409, 1997 month unknown.
Thomas et al., "Photosensitive Field Emission from Silicon Point Arrays," *Applied Physics Letters,* vol. 21, No. 8, pp.384–386, 1972 month unknown.
Radon et al., "Photofield Emission Spectroscopy of Ba on W," *ACTA Physica Polonica A,* vol. 87, No. 3, pp. 657–662, 1995 month unknown.
Radon, T., "PhotoField Emission Spectroscopy of Gamma–P and Gamma–<013> bands of tungsten," *Surface Science,* vol. 100, No. 2, pp. 353–367, 1980 month unknown.
PCT/US98/25072 International Search Report dated Apr. 16, 1999.

OPTOELECTRONIC DEVICES IN WHICH A RESONANCE BETWEEN OPTICAL FIELDS AND TUNNELING ELECTRONS IS USED TO MODULATE THE FLOW OF SAID ELECTRONS

RELATED APPLICATION

This application claims priority from provisional application Serial No. 60/072,389, filed Jan. 9, 1998.

BACKGROUND OF THE INVENTION (a) Field of the Invention

The present invention relates generally to optoelectronics and, more particularly, to an optoelectronic device based on electric current gating due to resonant interaction of tunneling electrons with optical fields.

(b) Description of Related Art

Optically-gated electrical switches, such as Auston switches, are commonly used in the generation of high frequency terahertz (THz) signals. Optically-gated switches typically include an optical pulse generator (e.g., a laser) and a photoconductor switch mounted on a miniature antenna. When the optical pulse generator is active, it emits an optical field that is focused on the photoconductor switch. The photoconductor switch conducts current in response to the optical field. Rapid switching of the optical pulse generator and the associated switching of the current through the photoconductor switch cause the antenna to emit high frequency signals. The miniature antenna couples the high frequency signal from the photoconductor switch to other circuitry that utilizes or processes the high frequency signal.

The switching speed of an optically-gated electrical switch is limited by the photoconductor switch and not by the optical pulse generator. Optical pulses having 50 femptosecond (fs) pulse widths may be produced by commercially available $TI:Al_2O_3$ lasers from various manufacturers (e.g., Coherent Laser Group and Spectra Physics). Optical pulses as short as 6 fs have been experimentally produced using cubic phase compensation. Pulses of this duration correspond to electrical signals having a frequency of approximately 100 THz. However, these switching speeds are not realizable due to the relatively slow response of the photoconductor switches.

Another application of optoelectronic devices is photomixing. Photomixing uses two lasers and a material having non-linear optical properties to generate a signal at the difference frequency. For example, two $Ti:Al_2O_3$ lasers may be focused on an epitaxial layer of gallium arsenide (GaAs). The interaction of the two lasers and the GaAs substrate creates a difference frequency signal based on the difference between the laser frequencies. The epitaxial GaAs substrate may be located at the driving point of a miniature antenna that couples the difference frequency signal to other circuitry for processing. Typically, these devices have an output power less than 1 microwatt at 1 THz, and a roll off rate of 12 dB per octave.

A major effort is being made at several laboratories to develop microwave amplifiers based on field emitter arrays (FEA). These devices operate as triodes, in which a gate electrode controls the current. These devices have a unity gain bandwidth of less than 2 GHz because the input is shunted by the gate capacitance. The use of lasers to gate electron emission from a field emitter array (FEA) is also a topic of current research. Current experiments have used a Nd:YAG pulsed laser operating at a wavelength of 1 micrometer($\mu$m) to stimulate electron emission from an array of emitting tips. The emitting tips were made from silicon tantalum disilicide and were coated with gold. The laser beam was focused to a diameter of 3 mm or 4 mm on the emitting tips, with the optical propagation vector in the plane of the tips. The laser's pulse width was 5 nanoseconds (ns). When the power flux density of the laser was $2.7\times10^{11}$ $W/m^2$, a pulsed current was emitted from the tips. There was no pulse of current when a lower power flux density was used, and when the power flux density was increased to $4.2\times10^{12}$ $W/m^2$ the tips fused due to the intense heat from the process. However, the current pulse was only present when a gold tip coating was used, which suggests that the current pulse may be due to ions caused by field-induced evaporation. The minimum duration for a current pulse obtained in this manner is 2 nanoseconds (ns). This design requires the laser to supply a pulsed power of at least 2 megawatts (MW) to produce a detectable current pulse. This laser power level is not practical for most optical switching and mixing applications.

Accordingly, there is a need for new devices having bandwidths much greater than 1 THz, but this has not been possible with prior configurations. The performance of prior configurations is limited by the magnitude and frequency dependence of the nonlinear response of available materials. The performance of prior configurations based on field emission has also been limited by the use of a triode configuration. Additionally, prior configurations require extremely high optical power to produce detectable current emission.

SUMMARY OF THE INVENTION

The present invention may be embodied in an optoelectronic device including an evacuated chamber containing a negatively-biased source electrode having a pointed tip for emitting electrons and a coating for enhancing the effect of an optical field impinging on the source electrode, a laser generator for emitting an optical field that is focused on the pointed tip of the source electrode for stimulating emission of rapidly varying electrical current from the pointed tip of the source electrode, and means responsive to the rapidly-varying electrical current for coupling the signal produced by said current outside of said evacuated chamber.

In accordance with the present invention the optical field from the laser generator has a resonant interaction with the pointed tip. Additionally, the source electrode may be fabricated from various materials such as tungsten, molybdenum, iridium, titanium, zirconium, hafnium, aluminum nitride, gallium nitride, diamond-like carbon, molybdenum silicide, and refractory metal carbides such as zirconium carbide or hafnium carbide. These materials may be used either singly or combined as in coatings. The pointed tip may also include micro-protrusions, macro-outgrowths, supertips, and ultrasharp fibrils to increase the local curvature of the surface.

To enhance the effect of the optical field, a coating may be deposited on the pointed tip. This coating may include silver, aluminum or gallium.

In accordance with the present invention, the coupling means may include a Goubau line, a traveling wave log-periodic antenna or a dielectric waveguide. The dielectric waveguide may be fabricated from quartz, aluminum nitride, silicon, germanium or diamond-like carbon.

The invention itself, together with further objects and attendant advantages, will best be understood by reference to the following detailed description, taken in conjunction with the accompanying drawings.

DESCRIPTION OF THE PREFERRED EMBODIMENTS

Figure 1:
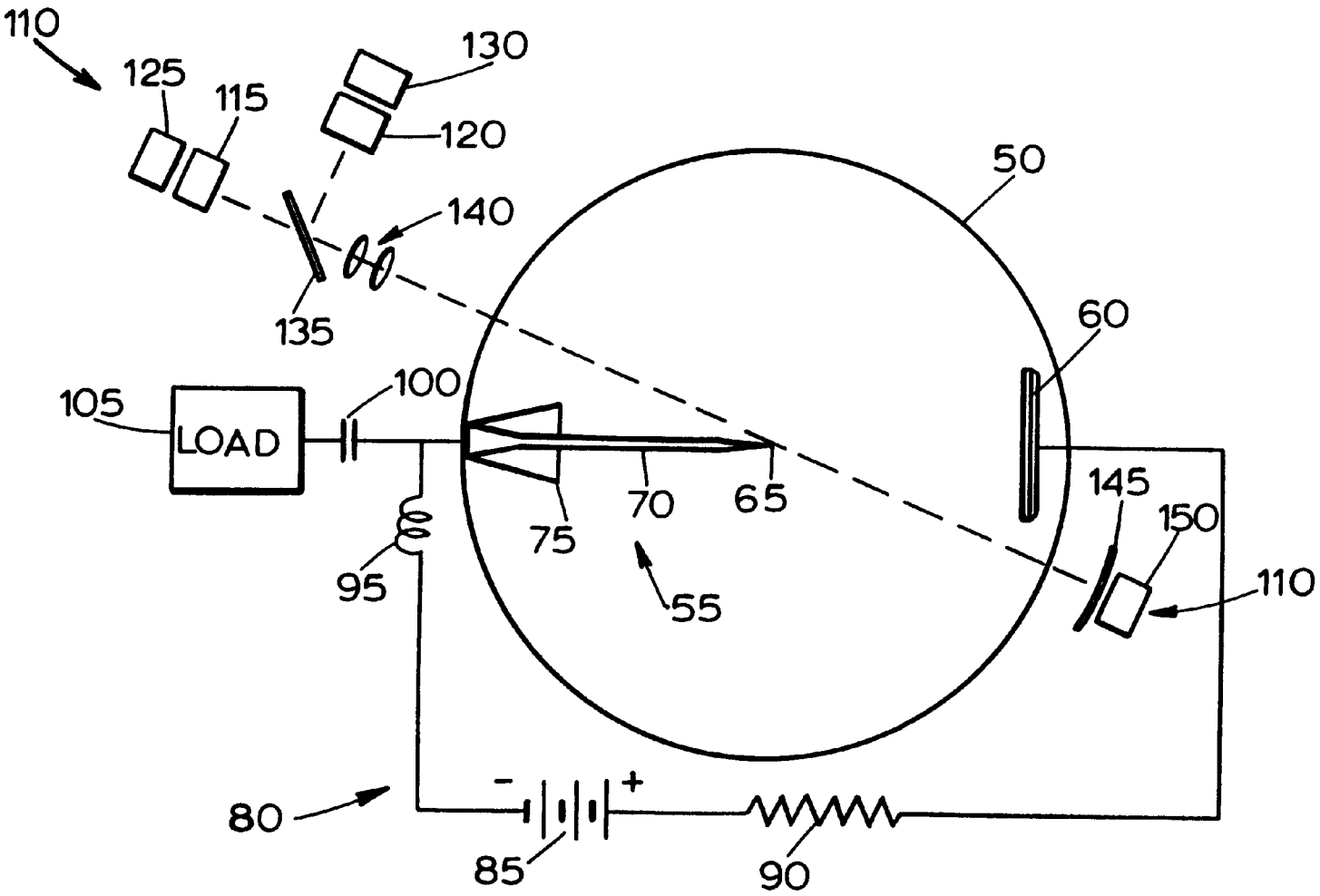
FIG. 1 is a diagram of an optical mixer including a Goubau line of the present invention.

The present invention is based on laser-assisted field emission rather than the nonlinear response of materials. The increased switching speed of the present invention is possible in part because of the extremely high values of the current density (~$10^9$ A/$m^2$) and extraction field (~10V/nm), and the extremely short length of the interaction (~1 nm). These parameters far exceed the parameters that may be achieved using semiconductor technology.

Experimentation and simulations have revealed a quantum resonance in the interaction of optical fields with tunneling electrons. This resonant interaction causes an increase in the signal current by approximately 30 dB. The mechanism for this resonance is reinforcement of the wave function by reflections at the classical turning points for electrons in the potential barrier. Thus, for the case of a square potential barrier, the resonance occurs when an electron is promoted above the potential barrier by absorbing one quantum from the optical field and when the length of the barrier is an integral multiple of one-half of the DeBroglie wavelength. In laser-assisted field emission the optical wavelength for resonance depends on the applied static field, the material used for the emitting tip, and the temperature. For example, with tungsten at room temperature, the resonance is at 500 nm with 6 V/nm and 400 nm with 5 V/nm.

By way of example, the optoelectric devices of the present invention will be described as a source electrode having a pointed electron-emitting tip and a collector, sealed within an evacuated chamber. A DC voltage source is connected between the pointed electron-emitting tip and the collector to create a static electric field. In accordance with the present invention, the emitting tip is irradiated with an optical field from a laser generator source. The optical field causes the electric vector of the radiation field to be superimposed on the applied static field, thereby changing the height of the potential barrier at the surface of the tip. Thus, the probability of electron emission by quantum tunneling is increased. The interaction between the optical energy and the electrons emitted by the pointed electron-emitting tip may be referred to as a resonant interaction. The optical fields cause a rapid variation in the current or signal emitted at the surface of the source electrode. The power of the current or signal emitted at the surface of the source electrode is proportional to the square of the static current and the square of the power flux density of the optical field. To effectively utilize this resonant effect, efficient means are required to 1) increase the density of the static current, 2) increase the effect of the laser on the emitted current, and 3) couple the high frequency energy to the load from the tip surface where the signal is generated. In accordance with the present invention, a number of different configurations are proposed that meet these requirements. The optoelectric devices of the present invention may be embodied in optical mixers or high speed switches that are gated by optical pulses.

Figure 2:
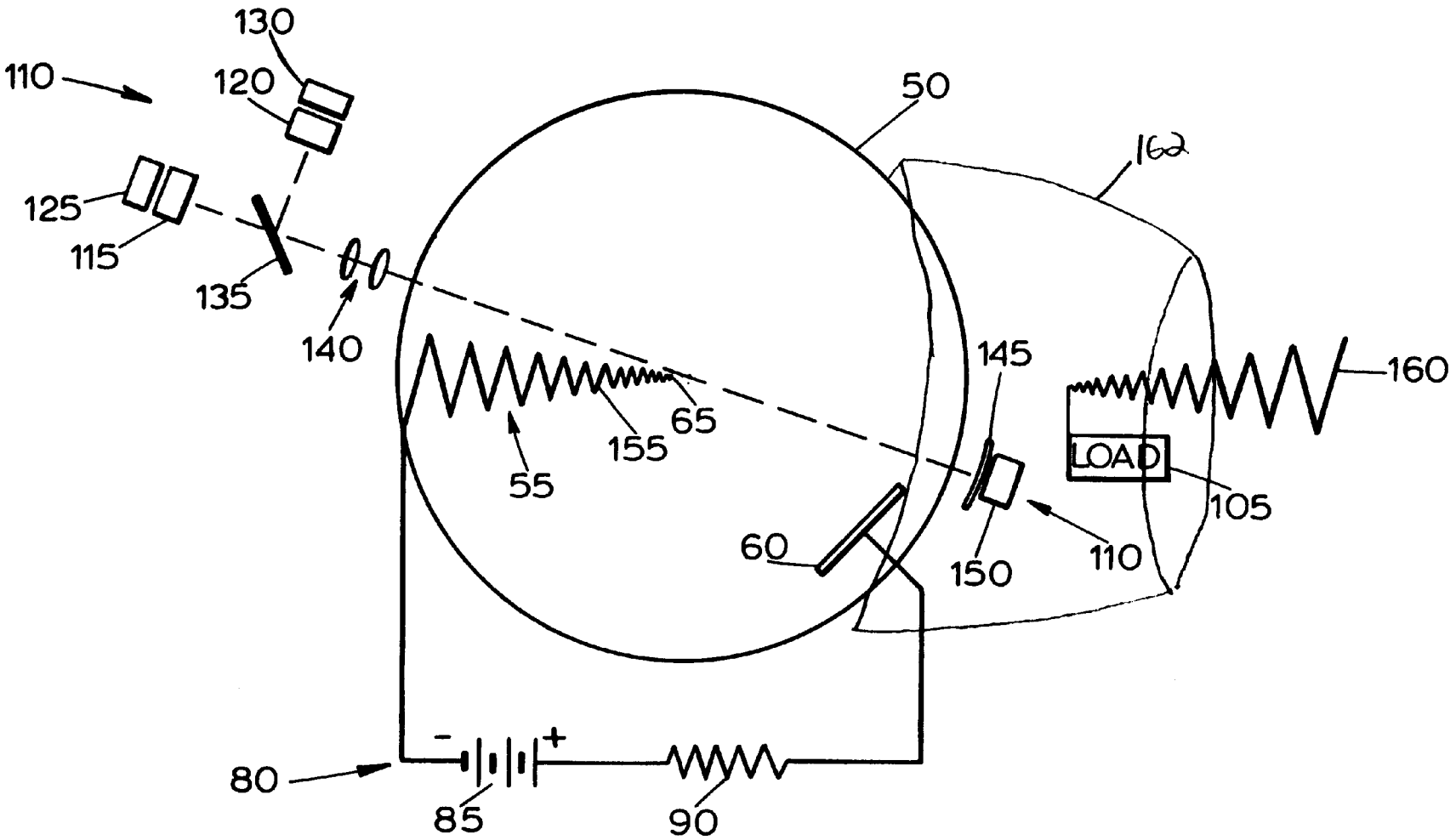
FIG. 2 is a diagram of an alternate embodiment of an optical mixer including a traveling wave log-periodic antenna in accordance with the present invention.
Figure 3:
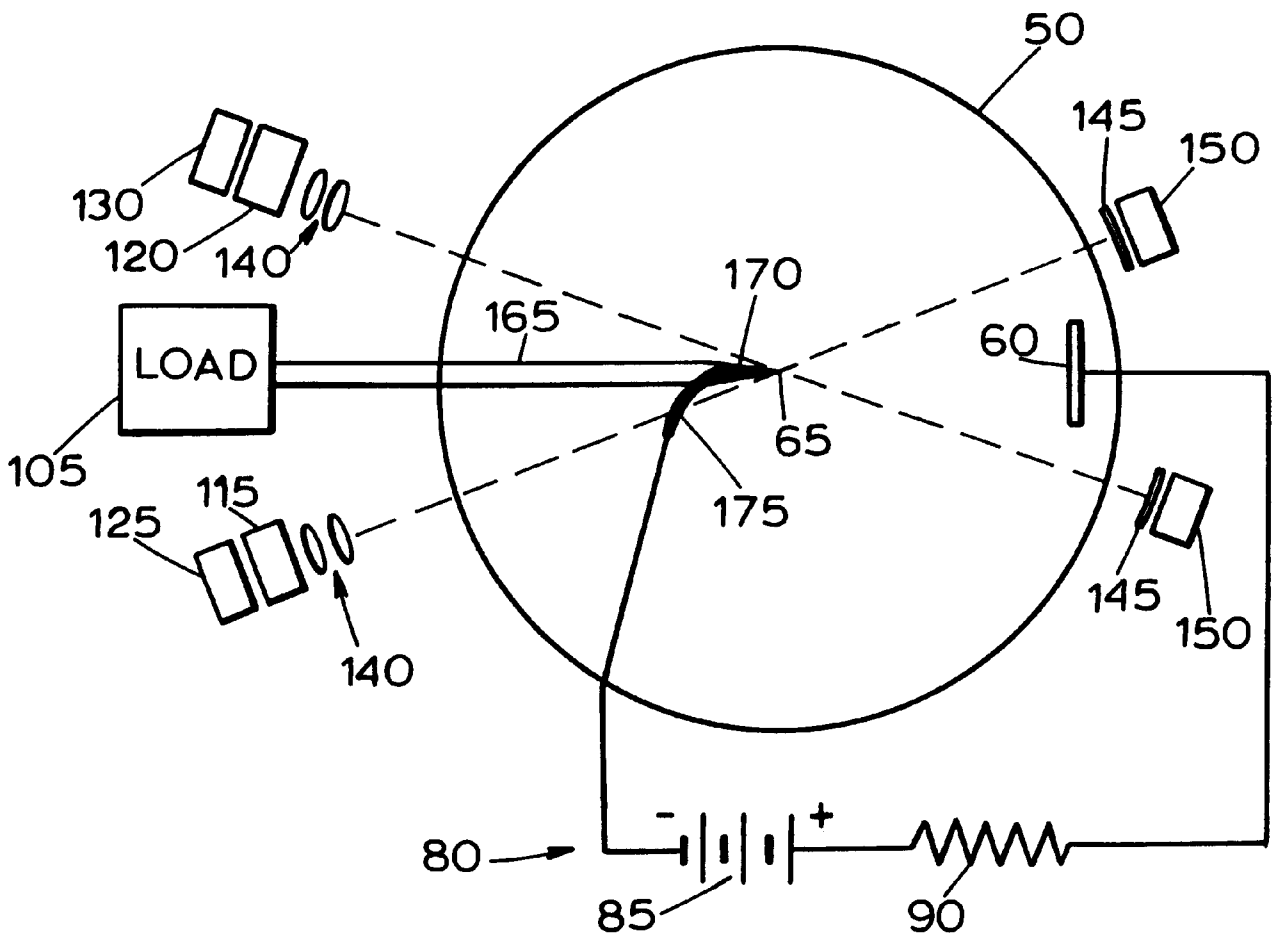
FIG. 3 is a diagram of an alternate embodiment of an optical mixer including a dielectric waveguide in accordance with the present invention.

FIGS. 1–3 illustrate three embodiments that use the present invention for photomixing. Photomixing is a process that is used to generate high quality signals that are tunable over an extremely large bandwidth without the use of high-speed electrical drivers. In accordance with the present invention, the mixing signal may be modulated by superimposing an information-carrying signal on the DC bias of the tip. Additionally, modulation may be accomplished through modulation of one or more of the optical sources. Each of the embodiments shown in FIGS. 1–3 may also be used to mix a single optical source with an external optical source to accomplish homodyne and heterodyne detection in coherent optical fiber and optical beam communications at extremely high data rates. Moreover, the present invention may be used in applications with a single optical source that is mode-locked or Q-switched to produce short optical pulses at a highly stable repetition rate. Such a device would respond to the repeated short optical pulses by generating a frequency comb at harmonics of the repetition frequency.

Referring now to FIG. 1, a photomixer using a Goubau line to couple the emitted signal from the evacuated chamber is shown. The photomixer shown in FIG. 1 includes an evacuated chamber 50, which contains a source electrode 55 and a collector 60. To increase the static current density, the source electrode 55 may be fabricated from various materials such as tungsten, molybdenum, iridium, titanium, zirconium, hafnium, aluminum nitride, gallium nitride, diamond-like carbon, molybdenum silicide, and refractory metal carbides such as zirconium carbide or hafnium carbide. These materials may be used either singly or combined as in coatings. The source electrode 55 includes a pointed electron-emitting tip 65, which may include features such as micro-protrusions, macro-outgrowths or super tips. These features may be created using well known heating techniques, electron deposition or other techniques known to those skilled in the art. The purpose of these features is to increase the local curvature by roughening the tip 65. These features increase the static current density by as much as 20 dB.

The pointed electron-emitting tip 65 is coupled to a Goubau line 70, which in turn is connected to a horn transition 75. External circuitry 80 is used to appropriately bias the emitter and the collector. The external circuitry includes a DC voltage source 85, a current limiting resistor 90, an RF choke 95, a coupling capacitor 100, and a load 105. Additionally, the photomixer includes optical components 110, which are used to irradiate the pointed electron-emitting tip 65 with an optical field. The optical components 110 include two laser diodes 115, 120 each mounted on piezoelectric transducer positioners 125, 130, a beam splitter 135, a lens system 140, and a spherical mirror 145 mounted on a piezoelectric transducer 150.

During mixer operation, the DC voltage source 85 negatively biases the source electrode 55 and positively biases the collector 60. The current limiting resistor 90 is provided to limit the amount of current that is sourced by the DC voltage source 85. When the source electrode 55 is properly biased, an optical field emitted by the laser diodes 115, 120 is combined using the beam splitter 135 and focused on the pointed electron-emitting tip 65 using the lens system 140.

External cavity lasers could be used to obtain a stable single-line optical field for photomixing in a compact device. An external cavity laser is a laser diode in which a reflecting surface of the internal cavity is replaced by an external mirror or grating to obtain a greater cavity length. The external cavity configuration makes it possible to separate various lines of radiation from the laser. The disadvantage to external cavity lasers is the fact that the output of the external cavity is typically less than 10% of the output from the laser itself. This derating is due to the fact that the external cavity must have a high quality factor, so the power removed from it must be a small fraction of the output from the laser. In accordance with the present invention, the external laser cavity is preferably integrated with the evacuated chamber 50. This configuration increases the coupling of the optical fields to the electron-emitting tip 65 by approximately 20 dB. Additionally, in a preferred embodiment, the angle between the propagation vector of the optical field and the axis of the pointed electron-emitting tip 65 is approximately 15°. This configuration enhances the effect that the optical field has on the emission from the pointed electron-emitting tip 65 by as much as 30 dB.

The spherical mirror 145 re-focuses and reflects the optical field from the lasers 115, 120 back to the lens system 140, thereby irradiating the electron-emitting tip 65 on the return path. The lasers 115, 120 and the spherical mirror 145 are mounted on piezoelectric transducer positioners (PZTs) 125, 130, 150. The PZTs 125, 130, 150 are used to adjust the positions and of the laser diodes 115, 120 and the spherical mirror 145 in response to applied voltages. The PZTs 125, 130, 150 are used to adjust the size of the external cavities and thereby shifting the frequency of the mixing signal in response to the voltage applied to the PZTs 125, 130, 150. Voltages applied to the lasers 115, 120 may also be used to modulate the lasers, thereby modulating the mixing product.

The optical fields cause a rapid variation in the emitted current at the surface of the source electrode, thereby creating a signal. However, the extremely high frequency components of the signal decay rapidly as the signal propagates along the pointed tip 65 due to attenuation and dispersion. Also, the spread of velocities in the emitted electrons causes bunching of the emitted signal to be dispersed as the electrons move a short distance from the pointed tip 65 toward the collector 60. Thus, it is necessary to use an efficient means to couple the high frequency energy from the pointed tip 65 to the load 105.

In accordance with the present invention, the optical field is controlled to operate in resonance with the pointed electron-emitting tip 65, which is coated with materials such as silver, aluminum, and gallium to create surface plasmons. Surface plasmons increase the local intensity of the optical field by as much as 60 dB, thereby enhancing the effect of the optical field and reducing the output power requirements on the laser diodes 115, 120. The combination of the DC bias and the resonant optical field causes electron emission from the pointed electron-emitting tip 65. The electrons are emitted toward the positively-biased collector 60. The emission of the electrons generates a signal at the surface of the pointed electron-emitting tip 65. This signal propagates as a Sommerfeld wave, which is a surface wave that is loosely bound to an imperfect conductor. Preferably, during manufacture a thin coating of low-loss dielectric is deposited on the source electrode 55, beginning near the apex of the tip 65 and continuing at an increasing thickness to provide a transition to the Goubau line 70. A Klopfenstein impedance taper or other related methods may be used to transition from the pointed electron-emitting tip 65 to the Goubau line 70. As the Sommerfeld wave reaches the Goubau line 70, it transitions into a Goubau wave, which is a surface wave that requires a dielectric layer for propagation. The Goubau wave is more closely bound to the tip than the Sommerfeld wave and has considerably less radiation loss.

As the Goubau wave propagates on the Goubau line 70, the DC current passes through the conductor under the dielectric of the Goubau line 70. The horn transition 75 is mounted at the end of the Goubau line 70 and is used to make the transition between the high impedance of the Goubau line and the low impedance of a coaxial line, which couples the signals to the external load 105. The load 105 may be circuitry that further processes the signal in accordance with a specific application. The RF choke 95 is used to block the RF signals from the horn transition 75 from entering the DC voltage source 85. Similarly, the coupling capacitor 100 is used to block the DC voltage signal from entering the load 105.

The design of a Goubau line 70 and the horn transition 75 from the Goubau line 70 to the coaxial line are known. Goubau line 70 with a horn transition 75 is useful for frequencies from 10 GHz to 10 THz. The lower limit of operation is set by the size of the horn transition 75. The upper limit of operation is set by excessive ohmic loss caused by the small size and high resistance of the metal conductor. At low operating frequencies, the horn transition 75 and the Goubau line could be self-supporting or connected to the evacuated chamber 50 using filaments. At higher frequencies, however, these structures could be supported using membrane technology or filament technology to limit field perturbations caused by the supports. For example, a thin dielectric membrane of silicon-oxynitride of about 1 $\mu$m thick could be used to support the horn transition 75 and the Goubau line 70.

FIG. 2 is a diagram of an alternate embodiment of a photomixer, which includes a transmitting traveling wave log-periodic antenna 155 and a receiving log-periodic antenna 160 for coupling signals from the evacuated chamber 50 to the load 105. In the embodiment shown in FIG. 2, the transmitting traveling wave log-periodic antenna operates in backfire mode. The signals generated at the pointed electron-emitting tip 65 decay rapidly as they propagate. Therefore, the transmitting antenna 155 is located close to the pointed electron-emitting tip 65. The transmitting antenna 155 is designed to have high radiation resistance because the signal current feeding the transmitting antenna 155 is very small. The transmitting antenna 155 also has high directive gain. Additionally, the transmitting antenna 155 also has a wide bandwidth because of its log-periodic structure.

A log-periodic antenna has three regions of operation: the transmission region, the active region, and the unexcited region. The physical location of these regions on the antenna is dependent on the frequency at which the antenna is operated. For example, as the frequency of operation is increased, the active region shifts toward the portion of the log-periodic antenna having smaller dimensions. In accordance with the present invention, the high-frequency portion of the antenna is positioned closest to the pointed electron-emitting tip 65. This placement effectively increases the bandwidth of the system because the highest frequency signals, which attenuate most rapidly, have their active region closest to the pointed electron-emitting tip 65. In a preferred embodiment, metal strip or planar forms of the traveling wave log-periodic antennas 155, 160 are used to lessen the attenuation. It is possible to further decrease the ohmic loss by shaping the surface of the antenna to add conductive ridges that are oriented to follow the direction of current flow. In a preferred embodiment, the transmitting and receiving log-periodic antennas are embodied in metal strip triangular-tooth or planar trapezoidal-tooth log-periodic antennas. For effective power transfer from the transmitting antenna 155 to the receiving antenna 160, it is necessary to use small tooth angles to increase the number of elements in the active region and thereby increase the radiation resistance of the antennas 155, 160. Alternatively, the log-periodic antenna may be constructed from wire. If wire is used, its radius is preferably tapered from 50–100 nm at the high frequency portion of the antenna to much larger radius values for regions in the low frequency portion.

Optionally, the present invention may include quasi-optical devices such as mirrors or lenses may be added to increase the coupling and correct for changes of the antenna pattern with frequency. For example, an ellipsoidal mirror 162 is especially appropriate because radiation from one focus (the antenna at the emitting tip) is exactly transferred to the second focus (the antenna at the load) without any distortions or aberrations. That is, the active portion of the transmitting antenna 155 is located at one focus of the mirror 162 and the receiving antenna 160 is located at the other focus of the mirror 162. The mirror 162 increases the coupling of in-phase radiation from the transmitting antenna 155 to the receiving antenna 160, thereby increasing the effective directivity of the transmitting and receiving antennas.

The embodiment shown in FIG. 2 is suitable for operation at frequencies between approximately 10 GHz and 100 THz. Traveling wave log-periodic antennas such as those described in conjunction with the preferred embodiment may have a directive gain in excess of 10 dB and a radiation resistance of 400Ω or more.

FIG. 3 is a diagram of an alternate embodiment of a photomixer, which includes a dielectric waveguide 165 for coupling energy from the evacuated chamber 50 to the load 105. Preferably, the dielectric waveguide 165 is a dielectric ribbon waveguide having low loss over more than an octave of frequency operation.

The embodiment shown in FIG. 3 does not use a beam splitter as shown in the embodiments in FIGS. 1 and 2. Rather, the embodiment in FIG. 3 uses two lasers 115, 120 and two spherical mirrors 145. This configuration may be used as an alternative to the beam splitter and single spherical reflector configuration shown in FIGS. 1 and 2.

The dominant mode for dielectric ribbon waveguide 165 propagation has the electric field normal to the broad face of the waveguide. The dominant mode of propagation in a Goubau line has a radial electric vector. Therefore, the wave on the dielectric waveguide may be launched from the pointed electron-emitting tip 65 using a two stage transition. The first stage consists of a dielectric layer 170 starting near the pointed electron-emitting tip 65 and has an increasing thickness for a transition from the Sommerfeld wave to the Goubau wave. The second stage of the transition consists of a slit in the dielectric along the axis of the guide. The slit dielectric is peeled from the metal tip to form a flat dielectric ribbon for a transition from a Goubau wave to a dielectric waveguide 165. The metal continues as a DC coupling wire 175. A cylindrical dielectric waveguide may be used in place of the dielectric ribbon, in which case the DC coupling wire 175 is bent so that it leaves the axis of the guide and is coupled to the DC voltage source 85.

It is essential to add a choke to prevent the emitted signal from coupling to the DC voltage source 85. At low operating frequencies this choke may be embodied in an inductor or a coil. At high frequencies, however, this choke may be embodied in a sudden change in the impedance of the DC voltage coupling wire 175. A sudden change in the radius of the DC voltage coupling wire 175 is typically a sufficient choke at high frequencies. In either case, it is preferred to have the choke located near the transition between the DC coupling wire 175 and the tip.

At low frequencies the dielectric waveguide 165 and its associated structure could be self-supporting. At higher frequencies the dielectric waveguide 165 and its associated structures may be supported using membrane technology or filament technology. The embodiment shown in FIG. 3 is useful at operating frequencies between 10 GHz and 100 THz. However, the composition of the dielectric coating must be chosen based on the frequency of operation. For example, quartz functions satisfactorily as a dielectric from DC to 4 THz, aluminum nitride is usable from DC to 40 THz. Silicon dielectric is functional from DC to 200 THz except for a narrow absorption band near 17 THz. Germanium is useful from DC to 8 THz and from 15 THz to 150 THz. A diamond dielectric is functional from DC to 10 GHz, from 3 THz to 50 THz and from 120 THz to 1400 THz. Additionally, halides such as cesium iodide are usable from 4 THz to 1200 THz.

In general, the mixing signal from the embodiments shown in FIGS. 1–3 is greatest when the applied static field is near the upper limit that may be used for a given pointed electron-emitting tip. This effect is due to the fact that the ratio of the mixer current to the DC current is decreased as the static field is increased, since the ratio of the optical to the static electric field is decreased. However, the increase in the DC current as the static field is increased is so great that it overcomes the first effect, and thus the net effect is an increase in the current of the mixing signal.

Figure 4:
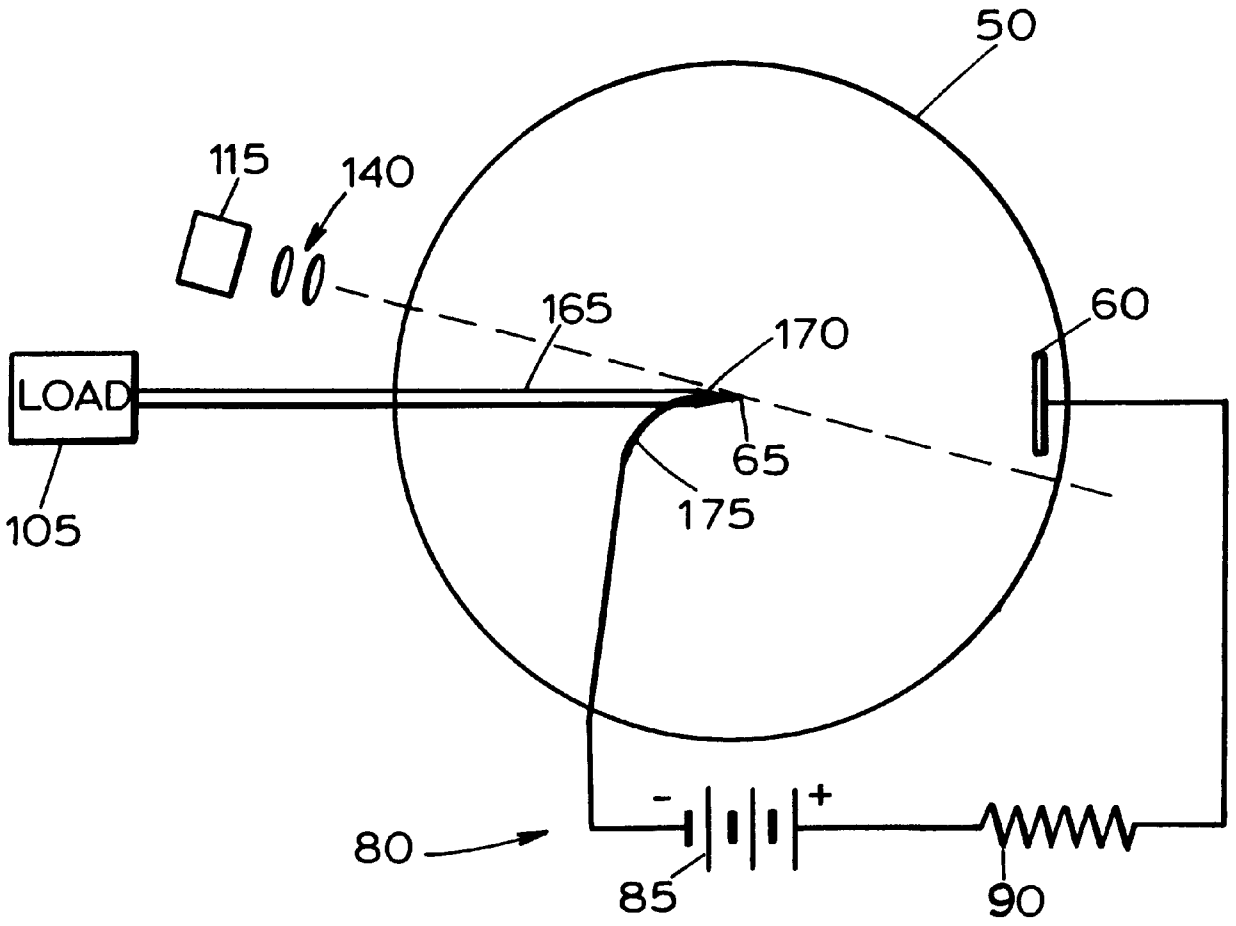
FIG. 4 is a diagram of a high speed switch in accordance with the present invention.

FIG. 4 is an embodiment of the present invention that is configured as a high-speed switch gated by an optical pulse. In addition to mixing, the embodiments shown in FIGS. 1–3 may also be used for switching. For example, they may be used in high-speed logic circuits as AND gates because the mixing signal will only be present when both lasers are on. Additionally, the embodiments in FIGS. 1–3 may be used as OR gates if the two lasers are each amplitude modulated at the desired frequency for the output.

Returning to FIG. 4, a high-speed optically gated switch is shown, which includes an evacuated chamber 50 housing a collector 60, a pointed electron-emitting tip 65, a dielectric waveguide 165 coated with a dielectric layer 170 starting near the pointed tip 65, and an RF choke, which may be embodied in a sudden change in the impedance of the DC coupling wire 175 such as a sudden change in the wire radius. The high-speed gated switch also includes a laser 115, a lens system 140, and bias circuitry 80. Absent from the embodiment shown in FIG. 4 is a spherical mirror to intensify the input optical pulse because the use of an external cavity would decrease the speed of the response. The operation of the high-speed optically gated switch is similar to the operation described in conjunction with FIGS. 1–3. That is, the external circuitry 80 biases the electron-emitting tip 65 and the tip is irradiated with optical energy from a laser 115. The combination of the bias and the optical field stimulates electron emission from the tip 65. The electron emission creates a high frequency signal that is coupled out of the evacuated chamber 50 to a load 105, via the dielectric waveguide 165. This embodiment functions like a high speed, high bandwidth transistor. That is, the optical signal gates the output of the device just as the base of a transistor gates the output of a transistor.

A device such as shown in FIG. 4 has numerous advantages over Auston switches in that the device of the present invention is more than 50 times faster than an Auston switch. The present invention is also less sensitive to ionizing radiation and less sensitive to changes in the ambient temperature than an Auston switch.

It is contemplated that a pointed electron-emitting tip, a transition, and a means to couple the high frequency signal out of the evacuated chamber may be integrated into one structure. This integration may be accomplished using, for example, silicon or any other suitable material. Roughened silicon having micro-protrusions, macro-outgrowths or supertips may be used as a pointed electron-emitting tip, while intrinsic silicon from the same wafer may be used as a dielectric transition to support the Goubau wave. To produce a static field, the silicon may be doped to conduct the DC current. Additionally, an antenna such as a traveling wave log-periodic antenna may be fabricated from another portion of the silicon wafer. This configuration decreases the size and increases the accuracy and efficiency of devices constructed according to the present invention. Diamond-like carbon, gallium nitride and aluminum nitride are efficient field emitters that may be doped for use in monolithic fabrication.

Of course, it should be understood that a range of changes and modifications can be made to the preferred embodiments described above. For example, in applications requiring considerable frequency agility, it may be necessary to reduce the total gain caused by use of the quantum resonance, optical cavities, and surface plasmons, but in applications requiring an extremely stable output, such as a local oscillator for mixing, it would be necessary to adjust these effects to maximize the quality factor. For applications at operating frequencies below 10 GHz it would be more convenient to couple the high frequency energy to the load by connecting a transmission line to a resistor or transformer that is connected in seris with the circuit, and located either inside or outside of the evacuated chamber, instead of using Goubau lines, antennas, or dielectric waveguides. Two or more functions can be performed by having more than one device in a single evacuated chamber, or by having three or more optical sources used with a single tip. For example, two lasers may be mixed to provide a local oscillator signal to be mixed with a high frequency input signal for coherent detection. This could be accomplished by using two separate devices in a single evacuated chamber, or by using three-wave mixing with a single tip. It is therefore intended that the foregoing detailed description be regarded as illustrative rather than limiting and that it be understood that it is the following claims, including all equivalents, which are intended to define the scope of this invention.

We claim:

1. An optoelectronic device comprising:

A) an evacuated chamber containing a negatively-biased source electrode having a pointed tip for emitting electrons and a coating on the source electrode for intensifying the effect of an optical field impinging on the source electrode by creating surface plasmons when the source electrode is irradiated by an optical field;

B) a laser generator for emitting an optical field that is focused on the pointed tip of said source electrode for stimulating emission of rapidly varying electrical current from the pointed tip of the source electrode; and C) means responsive to the rapidly-varying electrical current for coupling said current outside of said evacuated chamber.

2. The device of claim 1, wherein the optical field from the laser generator has a resonant interaction with the pointed tip.

3. The device of claim 1, wherein the source electrode comprises zirconium carbide.

4. The device of claim 1, wherein the source electrode comprises gallium nitride.

5. The device of claim 1, wherein the source electrode comprises aluminum nitride.

6. The device of claim 1, wherein the source electrode comprises diamond-like carbon.

7. The device of claim 1, wherein the source electrode comprises molybdenum silicide.

8. The device of claim 1, wherein the source electrode comprises silicon fibrils.

9. The device of claim 1, wherein the source electrode comprises metal carbide.

10. The device of claim 1, wherein the source electrode comprises hafnium carbide.

11. The device of claim 1, wherein the pointed tip comprises micro-protrusions.

12. The device of claim 1, wherein the pointed tip comprises macro-outgrowths.

13. The device of claim 1, wherein the pointed tip comprises a supertip.

14. The device of claim 1, wherein the coating for intensifying the effect of an optical field comprises silver.

15. The device of claim 1, wherein the coating for intensifying the effect of an optical field comprises aluminum.

16. The device of claim 1, wherein the coating for intensifying the effect of an optical field comprises gallium.

17. The device of claim 1, wherein the coupling means comprises a Goubau line.

18. The device of claim 1, wherein the coupling means comprises a traveling wave log-periodic antenna.

19. The device of claim 18, further comprising an elliptical mirror for enhancing the effectiveness of the coupling means.

20. The device of claim 1, wherein the laser generator is integrated into the evacuated chamber.

21. The device of claim 20, wherein the optical field from the laser generator intersects the axis of the pointed tip at approximately 15°.

22. The device of claim 1, wherein the coupling means comprises a dielectric waveguide.

23. The device of claim 22, wherein the dielectric waveguide comprises quartz.

24. The device of claim 22, wherein the dielectric waveguide comprises aluminum nitride.

25. The device of claim 22, wherein the dielectric waveguide comprises silicon.

26. The device of claim 22, wherein the dielectric waveguide comprises germanium.

27. The device of claim 22, wherein the dielectric waveguide comprises diamond-like carbon.

28. The device of claim 1, wherein the pointed tip and the coupling means are integrated together onto a substrate.

29. The device of claim 1, wherein the source electrode and the coupling means are supported within the evacuated chamber using membrane technology.

30. The device of claim 1, wherein the source electrode and the coupling means are supported within the evacuated chamber using filament technology.

31. The device of claim 1, wherein the coupling means comprises a transmission line connected across a resistor that is connected in series with the pointed tip.

32. The device of claim 1, wherein the coupling means comprises a transmission line connected a transformer that is connected in series with the pointed tip.

33. An optoelectronic device comprising:

A) an evacuated chamber containing a negatively-biased source electrode having a pointed tip for emitting electrons and a coating on the source electrode for intensifying the effect of an optical field impinging on the source electrode by creating surface plasmons when the source electrode is irradiated by an optical field;

B) a laser generator adapted to emit an optical field that is focused on the pointed tip of said source electrode to stimulate emission of rapidly varying electrical current from the pointed tip of the source electrode; and C) a Goubau line adjacent the pointed tip, wherein the Goubau line is adapted to couple the rapidly-varying electrical current outside of the evacuated chamber.

34. The device of claim 33, wherein the optical field from the laser generator has a resonant interaction with the pointed tip.

35. The device of claim 33, further comprising a load and a horn transition adjacent the Goubau line, wherein the horn transition is adapted to provide an impedance match between the Goubau line and the load.

36. The device of claim 35, wherein the source electrode comprises zirconium carbide.

37. The device of claim 35, wherein the source electrode comprises gallium nitride.

38. The device of claim 35, wherein the source electrode comprises silicon fibrils.

39. The device of claim 35, wherein the pointed tip comprises micro-protrusions.

40. The device of claim 35, wherein the coating for intensifying the effect of an optical field comprises silver.

41. The device of claim 35, wherein the coating for intensifying the effect of an optical field comprises aluminum.

42. The device of claim 35, wherein the coating for intensifying the effect of an optical field comprises gallium.

43. An optoelectronic device comprising:

A) an evacuated chamber containing a negatively-biased source electrode having a pointed tip for emitting electrons and a coating on the source electrode for intensifying the effect of an optical field impinging on the source electrode by creating surface plasmons when the source electrode is irradiated by an optical field;

B) a laser generator adapted to emit an optical field that is focused on the pointed tip of said source electrode to stimulate emission of rapidly varying electrical current from the pointed tip of the source electrode; and C) a transmission antenna adjacent the pointed tip, wherein the transmission antenna is adapted to radiate the rapidly-varying electrical current outside of the evacuated chamber.

44. The device of claim 43, wherein the optical field from the laser generator has a resonant interaction with the pointed tip.

45. The device of claim 43, wherein the transmission antenna comprises a traveling wave log-periodic antenna.

46. The device of claim 43, wherein the laser generator is integrated into the evacuated chamber.

47. The device of claim 43, wherein the optical field from the laser generator intersects the axis of the pointed tip at approximately 15°.

48. The device of claim 43, further comprising a reception antenna and a load, wherein the reception antenna is coupled to the load and is adapted to receive the rapidly-varying electrical current radiated by the transmission antenna.

49. The device of claim 48, wherein the reception antenna comprises a traveling wave log-periodic antenna.

50. The device of claim 48, further comprising an elliptical mirror for intensifying the effectiveness of the coupling between the transmission antenna and the reception antenna.

51. An optoelectronic device comprising:

A) an evacuated chamber containing a negatively-biased source electrode having a pointed tip for emitting electrons and a coating on the source electrode for intensifying the effect of an optical field impinging on the source electrode by creating surface plasmons when the source electrode is irradiated by an optical field;

B) a laser generator adapted to emit an optical field that is focused on the pointed tip of said source electrode to stimulate emission of rapidly varying electrical current from the pointed tip of the source electrode; and C) a dielectric waveguide adjacent the pointed tip, wherein the dielectric waveguide is adapted to couple the rapidly-varying electrical current outside of the evacuated chamber.

52. The device of claim 51, wherein the optical field from the laser generator has a resonant interaction with the pointed tip.

53. The device of claim 51, wherein the dielectric waveguide comprises quartz.

54. The device of claim 51, wherein the dielectric waveguide comprises aluminum nitride.

55. The device of claim 51, wherein the pointed tip and the dielectric waveguide are integrated together onto a substrate.

56. The device of claim 51, wherein the source electrode and the dielectric waveguide are supported within the evacuated chamber using membrane technology.

57. The device of claim 51, wherein the source electrode and the dielectric waveguide are supported within the evacuated chamber using filament technology.

* * * * *